United States Patent [19]

Reed et al.

[11] Patent Number: 5,015,358

[45] Date of Patent: May 14, 1991

[54] ANTIFOULANTS COMPRISING TITANIUM FOR THERMAL CRACKING PROCESSES

[75] Inventors: Larry E. Reed; Randall A. Porter, both of Bartlesville, Okla.

[73] Assignee: Phillips Petroleum Company, Bartlesville, Okla.

[21] Appl. No.: 575,246

[22] Filed: Aug. 30, 1990

[51] Int. Cl.[5] ..... C10G 9/16

[52] U.S. Cl. ..... 208/48 AA; 585/950

[58] Field of Search ..... 208/48 AA; 585/950

[56] References Cited

U.S. PATENT DOCUMENTS

| | | | |
|---|---|---|---|
| 4,148,714 | 4/1979 | Nielsen et al. | 208/48 AA |
| 4,166,806 | 9/1979 | McKay et al. | 208/48 AA |
| 4,198,317 | 4/1980 | Bertus et al. | 208/48 AA |
| 4,263,130 | 4/1981 | Bertus et al. | 208/48 AA |
| 4,263,131 | 4/1981 | Bertus et al. | 208/48 AA |
| 4,404,087 | 9/1983 | Reed et al. | 208/44 AA |
| 4,427,721 | 1/1984 | Cairns et al. | 427/376.5 |
| 4,507,196 | 4/1985 | Reed et al. | 208/44 AA |
| 4,511,405 | 4/1985 | Reed et al. | 106/15.05 |
| 4,545,893 | 10/1985 | Porter et al. | 208/48 R |
| 4,551,227 | 11/1985 | Porter et al. | 208/48 AA |
| 4,552,643 | 12/1985 | Porter et al. | 208/48 AA |
| 4,613,372 | 9/1986 | Porter et al. | 106/1.13 |
| 4,686,201 | 8/1987 | Porter et al. | 502/154 |
| 4,687,567 | 8/1987 | Porter et al. | 208/48 AA |
| 4,692,234 | 9/1987 | Porter et al. | 208/44 AA |
| 4,692,313 | 9/1987 | Watanabe et al. | 422/241 |
| 4,863,892 | 9/1989 | Porter et al. | 502/170 |

FOREIGN PATENT DOCUMENTS

| | | |
|---|---|---|
| 2066696 | 7/1981 | United Kingdom . |
| 1602098 | 11/1981 | United Kingdom . |

*Primary Examiner*—Helane E. Myers

*Attorney, Agent, or Firm*—K. K. Brandes

[57] ABSTRACT

The formation of carbon on metals exposed to hydrocarbons in a thermal cracking process is reduced by contracting these metals with an antifoulant selected from the group consisting of a combination of titanium and tin and a combination of titanium and antimony.

23 Claims, 2 Drawing Sheets

ANTIFOULANTS COMPRISING TITANIUM FOR THERMAL CRACKING PROCESSES

BACKGROUND OF THE INVENTION

This invention relates to processes for the thermal cracking of a gaseous stream containing hydrocarbons. In one aspect this invention relates to a method for reducing the formation of carbon on the cracking tubes in furnaces used for the thermal cracking of a gaseous stream containing hydrocarbons and in any heat exchangers used to cool the effluent flowing from the furnaces. In another aspect this invention relates to particular antifoulants which are useful for reducing the rate of formation of carbon on the walls of such cracking tubes and in such heat exchangers.

The cracking furnace forms the heart of many chemical manufacturing processes, such as the manufacture of ethylene and other valuable hydrocarbon products from ethane and/or propane and/or naphtha. A diluent fluid such as steam is usually combined with the hydrocarbon feed material being provided to the cracking furnace. Within the furnace, the feed stream which has been combined with the diluent fluid is converted to a gaseous mixture which primarily contains hydrogen, methane, ethylene, propylene, butadiene, and small amounts of heavier gases. At the furnace exit this mixture is cooled, so as to remove most of the heavier gases, and then compressed. The compressed mixture is routed through various distillation columns where the individual components such as ethylene are purified and separated. A semi-pure carbon which is termed "coke" is formed in the cracking furnace as a result of the furnace cracking operation. Coke is also formed in the heat exchangers used to cool the gaseous product mixture flowing from the cracking furnace. Coke formation generally results from a combination of a homogeneous thermal reaction in the gas phase (thermal coking) and a heterogeneous catalytic reaction between the hydrocarbon in the gas phase and the metals in the walls of the cracking tubes or heat exchangers (catalytic coking).

Coke is generally referred to as forming on the metal surfaces of the cracking tubes which are contacted with the hydrocarbon-containing feed stream and on the metal surfaces of the heat exchangers which are contacted with the gaseous effluent from the cracking furnace. However, it should be recognized that coke may also form on connecting conduits and other metal surfaces which are exposed to hydrocarbons at high temperatures. Thus, the term "Metals" will be used hereinafter to refer to all metal surfaces in a cracking process which are exposed to hydrocarbons and which are subject to coke deposition.

A normal operating procedure for a cracking furnace is to periodically shut down the furnace in order to burn out the deposits of coke. This downtime results in a substantial loss of production. In addition, coke is a poor thermal conductor. Thus, as coke is deposited, higher furnace temperatures are required to maintain the gas temperature in the cracking zone at a desired level. Such higher temperatures increase fuel consumption and will eventually result in shorter tube life.

Another problem associated with carbon formation is erosion of the Metals, which occurs in two fashions. First, it is well known that in the formation of catalytic coke the metal catalyst particle is removed or displaced from the surface and entrained within the coke. This phenomenon results in rapid metal loss and, ultimately, Metals failure. A second type of erosion is caused by carbon particles that are dislodged from the tube walls and enter the gas stream. The abrasive action of these particles can be particularly severe on the return bends in the furnace tube.

Another effect of coke formation occurs when coke enters the furnace tube alloy, generally a steel which contains chromium as a minor component in the form of a solid solution. The carbon then reacts with the chromium in the alloy to form chromium carbide. This phenomena, known as carburization, causes the alloy to lose its original oxidation resistance, thereby becoming susceptible to chemical attack. The mechanical properties of the tube are also adversely affected. Carburization may also occur with respect to iron and nickel in the alloys.

Even though various antifoulants have been described in the patent literature, e.g., in U.S. Pat. Nos. 4,404,087, 4,507,196, 4,545,893, 4,551,227, 4,552,643, 4,687,567 and 4,692,234, there is an ever present need to develop alternative antifoulant systems which may exhibit various advantages and may be environmentally more acceptable than known antifoulants.

SUMMARY OF THE INVENTION

It is an object of this invention to provide a method for reducing the formation of coke on Metals. It is another object of this invention to provide particular antifoulants which are useful for reducing the formation of carbon on Metals. Other objects and advantages of the invention will be apparent from the foregoing brief description of the invention and the claims as well as the detailed description of the drawings.

In accordance with the present invention, an antifoulant selected from the group consisting of combinations of tin and titanium and combinations of antimony and titanium is contacted with the Metals either by pretreating the Metals with the antifoulant, adding the antifoulant to the hydrocarbon containing feedstock flowing to the cracking furnace, or both. Preferably, the antifoulant is dissolved in a suitable solvent. The use of the antifoulant substantially reduces the formation of coke on the Metals which alleviates the adverse consequences of such coke formation.

Also in accordance with the present invention, a combination of titanium and tin is provided. Further in accordance with this invention, a combination of titanium and antimony is provided.

DETAILED DESCRIPTION OF THE INVENTION

Figure 1:
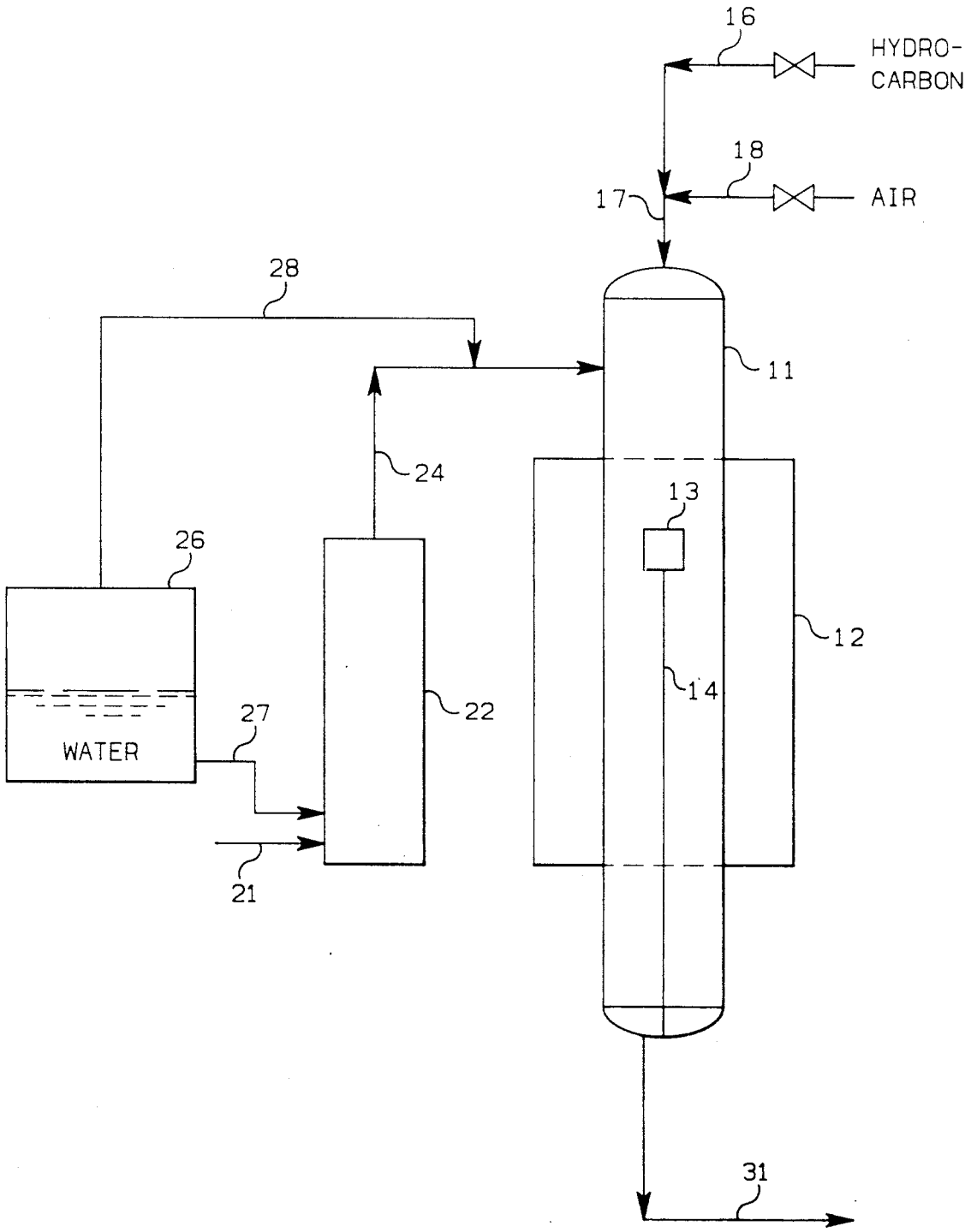
FIG. 1 is a diagrammatic illustration of the test apparatus used to test the effectiveness of antifoulants.

The invention is described in terms of a cracking furnace used in a process for the manufacture of ethylene. However, the applicability of the invention described herein extends to other processes wherein a cracking furnace is utilized to crack a feed material into some desired components and the formation of coke on the walls of the cracking tubes in the cracking furnace or other metal surfaces associated with the cracking process is a problem.

Any suitable form of titanium may be utilized in the combination of titanium and tin antifoulant and in the combination of titanium and antimony antifoulant. Elemental titanium, inorganic titanium compounds and organic titanium compounds as well as mixtures of any two or more thereof are suitable sources of titanium. The term "titanium" generaly refers to any one of these titanium sources.

Non-limiting examples of inorganic titanium compounds that can be used in combination with tin or antimony so as to provide the antifoulants of this invention are: titanium trifluoride, titanium tetrafluoride, sodium hexafluorotitanate(III), ammonium hexafluorotitanate(IV), titanium trichloride, titanium tetrachloride, titanyl chloride, titanium hexamminetetrachloride, titanium tribromide, titanium tetrabromide, titanium(III) sulfate, titanium(IV) sulfate, titanyl sulfate, ammonium titanium(III) sulfate, titanium dioxide, and the like. Halogen-containing titanium compounds are less preferred.

Non-limiting examples of organic titanium compounds that can be used are: hydrocarboxides of titanium, $Ti(OR)_4$, wherein each R is individually selected from the group consisting of alkyl, cycloalkyl and aryl groups which preferably contain 1-8 carbon atoms, such as titanium methoxide, titanium ethoxide, titanium n-propoxide, titanium isopropoxide, titanium n-butoxide, titanium isobutoxide, titanium sec-butoxide, titanium tert-butoxide, titanium n-pentoxide, titanium phenoxide, and the like. Other suitable organic compounds of titanium include diphenyltitanium, phenyl titanium triisopropoxide, phenylcyclopentadienyltitanium, diphenyldicyclopentadienyltitanium, and the like; titanium oxide bis(2,4-pentanedionate), titanium diisopropoxide bis(2,4-pentanedionate), and the like. Organic titanium compounds are preferred over inorganic compounds of titanium. At present, titanium n-butoxide is most preferred.

Any suitable form of antimony may be utilized in the combination of titanium and antimony antifoulant. Elemental antimony, inorganic antimony compounds and organic antimony compounds as well as mixtures of any two or more thereof are suitable sources of antimony. The term "antimony" generally refers to any one of these antimony sources.

Examples of some inorganic antimony compounds which can be used include antimony oxides such as antimony trioxide, antimony tetroxide, and antimony pentoxide; antimony sulfides such as antimony trisulfide and antimony pentasulfide; antimony sulfates such as antimony trisulfate; antimonic acids such as metaantimonic acid, orthoantimonic acid and pyroantimonic acid; antimony halides such as antimony trifluoride, antimony trichloride, antimony tribromide, antimony triiodide, antimony pentafluoride and antimony pentachloride; antimonyl halides such as antimonyl chloride and antimonyl trichloride. Of the inorganic antimony compounds, those which do not contain halogen are preferred.

Examples of some organic antimony compounds which can be used include antimony carboxylates such as antimony triformate, antimony triacetate, antimony trioctanoate, antimony tridodecanoate, antimony trioctadecanoate, antimony tribenzoate, and antimony tricyclohexanoate; antimony thiocarboxylates such as antimony tris(thioacetate), antimony tris(dithioacetate) and antimony tris(dithiopentanoate); antimony thiocarbonates such as antimony tris(O-propyl dithiocarbonate); antimony carbonates such as antimony tris(ethyl carbonates); trihydrocarbylantimony compounds such as triphenylantimony; trihydrocarbylantimony oxides such as triphenylantimony oxide; antimony salts of phenolic compounds such as antimony triphenoxide; antimony salts of thiophenolic compounds such as antimony tris(thiophenoxide); antimony sulfonates such as antimony tris(benzenesulfonate) and antimony tris(p-toluenesulfonate); antimony carbamates such as antimony tris(diethylcarbamate); antimony thiocarbamates such as antimony tris(dipropyldithiocarbamate), antimony tris(phenyldithiocarbamate) and antimony tris(-butylthiocarbamate); antimony phosphites such as antimony tris(diphenyl phosphite); antimony phosphates such as antimony tris(dipropyl) phosphate; antimony thiophosphates such as antimony tris(O,O-dipropyl thiophosphate) and antimony tris(O,O-dipropyl dithiophosphate) and the like. Organic compounds of antimony are preferred over inorganic compounds of antimony. At present, antimony 2-ethylhexanoate is most preferred.

Any suitable form of tin may be utilized in the combination of titanium and tin antifoulant. Elemental tin, inorganic tin compounds, and organic tin compounds as well as mixtures of any two or more thereof are suitable sources of tin. The term "tin" generally refers to any one of these tin sources.

Examples of some inorganic tin compounds which can be used include tin oxides such as stannous oxide and stannic oxide; tin sulfides such as stannous sulfide and stannic sulfide; tin sulfates such as stannous sulfate and stannic sulfate; stannic acids such as metastannic acid and thiostannic acid; tin halides such as stannous fluoride, stannous chloride, stannous bromide, stannous iodide, stannic fluoride, stannic chloride, stannic bromide and stannic iodide; tin phosphates such as stannic phosphate; tin oxyhalides such as stannous oxychloride and stannic oxychloride; and the like. Of the inorganic tin compounds those which do not contain halogen are preferred as the source of tin.

Examples of some organic tin compounds which can be used include tin carboxylates such as stannous formate, stannous acetate, stannous butyrate, stannous octanoate, stannous decanoate, stannous benzoate, and stannous cyclohexanoate; tin thiocarboxylates such as stannous thioacetate and stannous dithioacetate; dihydrocarbyltin bis(hydrocarbyl mercaptoalkanoates) such as dibutyltin bis(isooctyl mercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetrabutyltin, tetraoctyltin, tetradodecyltin, and tetraphenyltin; dihydrocarbyltin oxides such as dipropyltin oxide, dibutyltin oxide, butylstannonic acid, dioctyltin oxide, and diphenyltin oxide; dihydrocarbyltin bis(hydrocarbyl mercaptide)s such as dibutyltin bis(dodecyl mercaptide); tin salts of phenolic or thiophenolic compounds such as stannous phenoxide and stannous thiophenoxide; tin sulfonates such as stannous benzenesulfonate and stannous p-toluenesulfonate; tin carbamates such as stannous diethylcarbamate; tin thiocarbamates such as stannous propylthiocarbamate and stannous diethyldithiocarbamate; tin phosphites such as stannous diphenyl phosphite; tin phosphates such as stannous dipropyl phosphate; tin thiophosphates such as stannous O,O-dipropyl thiophosphate, stannic O,O-dipropyl dithiophosphate; dihydrocarbyltin bis-(O,O-dihydrocarbyl thiophosphate)s such as dibutyltin bis(O,O-dipropyl dithiophosphate); and the like. Again, as with antimony, organic tin compounds are preferred over inorganic tin compounds. At present stannous 2-ethylhexanoate and tetrabutyltin are most preferred.

Any of the listed sources of tin may be combined with any of the listed sources of titanium to form the combination of tin and titanium. In like manner, any of the listed sources of antimony may be combined with any of the listed sources of titanium to form the combination of antimony and titanium antifoulant.

Figure 2:
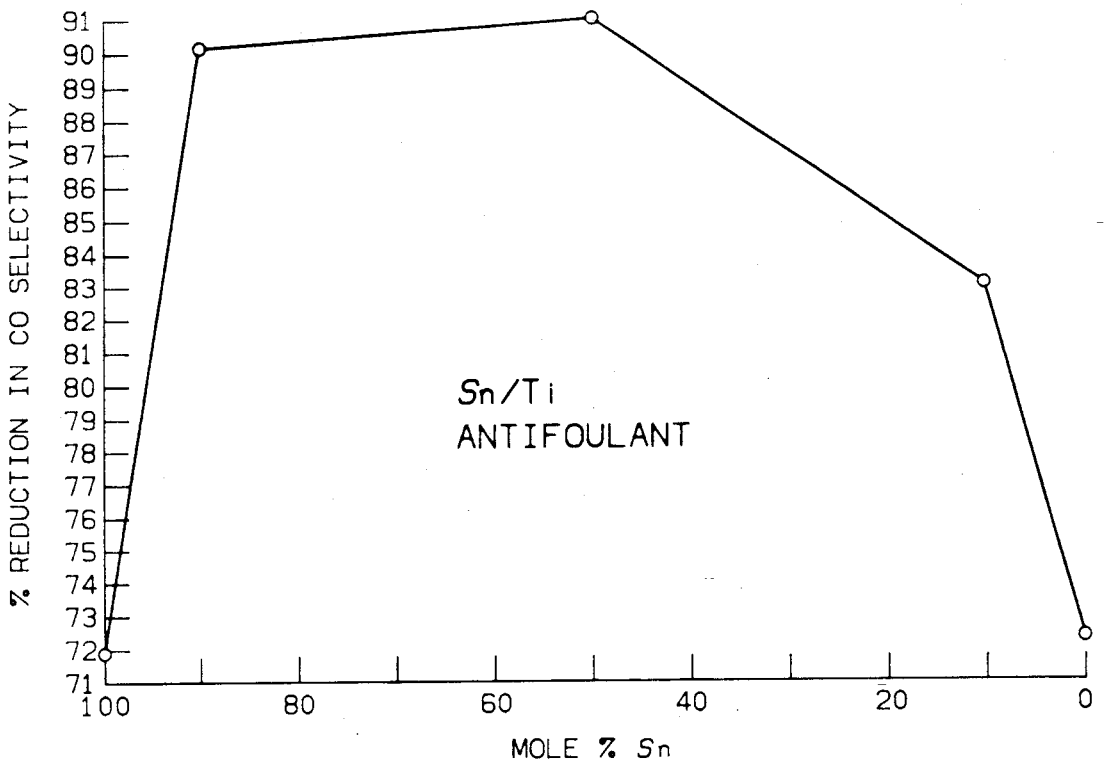
FIG. 2 is a graphical illustration of the antifoulant effect of combinations of tin and titanium.
Figure 3:
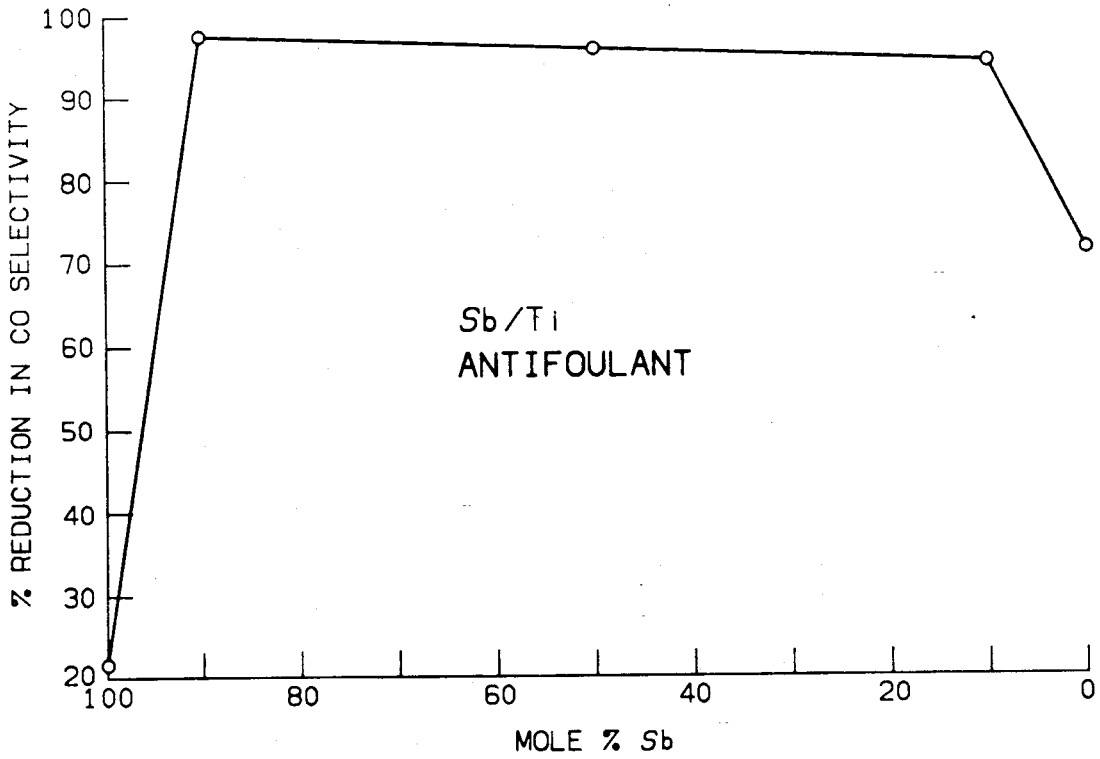
FIG. 3 is a graphical illustration of the antifoulant effect of combinations of antimony and titanium.

Any suitable concentration of antimony in the combination of titanium and antimony antifoulant may be utilized. A concentration of antimony in the range of about 10 mole percent to about 90 mole percent is presently preferred for the combination of titanium and antimony antifoulant so as to provide maximum coke-reducing effect (as is shown in FIG. 3). In like manner, any suitable concentration of tin may be utilized in the combination of titanium and tin antifoulant. A concentration of tin in the range of about 10 mole percent to about 90 mole percent is presently preferred for the combination of aluminum and tin antifoulant so as to maximize the coke-reducing effect (as is shown in FIG. 2).

In general, the antifoulants of the present invention are effective to reduce the buildup of coke on any of the high temperature steels. Non-limiting examples of commonly used steels in cracking tubes are Inconel 600, Incoloy 800, HK-40, and Type 304 Stainless Steel. The composition of these steels in weight percent is listed in Table I.

TABLE I

| Steel | Ni | Cu | C | Fe | S | Cr | Mn | Si |
|---|---|---|---|---|---|---|---|---|
| Inconel 600 | 72 | 0.5 | 0.15 | 8.0 | | 15.5 | | |
| Incoloy 800 | 32.5 | 0.75 | 0.10 | 45.6 | | 21.0 | | |
| HK-40 | 19-22 | | 0.35-0.45 | 50 | 0.40 max | 23-27 | 1.5 max | 1.75 max |
| 304 SS | 9.0 | | 0.08 | 72 | | 19 | | |

The antifoulants of the present invention can be contacted with the Metals either by pretreating the Metals with the antifoulant, adding the antifoulant to the hydrocarbon containing feedstock, or preferably both.

If the Metals are to be pretreated, a preferred pretreatment method is to contact the Metals with a solution (which may be colloidal) of the antifoulant while no hydrocarbon containing gas is in contact with the Metals. The cracking tubes are preferably flooded with the antifoulant. The antifoulant is allowed to remain in contact with the surface of the cracking tubes for any suitable length of time. A time of at least about one minute is preferred to insure that all of the surface of the cracking tube has been treated. The contact time would typically be about ten minutes or longer in a commercial operation. However, it is not believed that the longer times are of any substantial benefit other than to fully assure an operator that the cracking tube has been treated.

It is typically necessary to spray or brush the antifoulant solution on the Metals to be treated other than the cracking tubes, but flooding can be used if the equipment can be subjected to flooding.

Any suitable solvent may be utilized to prepare the solution (which may be colloidal) of antifoulants. Suitable solvents include water, oxygen-containing organic liquids such as alcohols, ketones and esters, and liquid aliphatic, cycloaliphatic and aromatic hydrocarbons and their derivatives. The presently preferred solvents are normal hexane and toluene, although kerosene would be a typically used solvent in a commercial operation.

Any suitable concentration of the antifoulant in the solution may be utilized. It is desirable to use a concentration of at least 0.05 molar, and concentrations may be 1 molar or higher with the strength of the concentrations being limited by metallurgical and economic considerations. The presently preferred concentration of antifoulant in the solution is in the range of about 0.3 molar to about 0.6 molar.

Solutions of antifoulants can also be applied to the surfaces of the cracking tube by spraying or brushing when the surfaces are accessible, but application in this manner has been found to provide less protection against coke deposition than flooding. The cracking tubes can also be treated with finely divided powders of the antifoulants or by vapor disposition, but these methods are presently less preferred.

In addition to pretreating of the Metals with the antifoulant, or as an alternate method of contacting the Metals with the antifoulant, any suitable concentration of the antifoulant may be added to the hydrocarbon feed stream, or to a diluent stream (such as steam) which is then mixed with the hydrocarbon feed stream prior to entering the cracking reactor, or to a mixture of hydrocarbon feed and diluent (such as steam) prior to entering the cracking reactor. Generally, a concentration of antifoulant in the hydrocarbon containing feed stream (i.e., the hydrocarbon feed stream or a mixture of hydrocarbon feed and diluent) of at least 5 parts per million by weight of the metal(s) contained in the antifoulant based on the weight of the hydrocarbon portion of the feed stream is used. Presently preferred concentrations of antifoulant metals in the feed stream are in the range of about 10 parts per million to about 100 parts per million based on the weight of the hydrocarbon portion of the feed stream. Higher concentrations of the antifoulant may be added to the feed stream, but the effectiveness of the antifoulant does not substantially increase and economic considerations generally preclude the use of higher concentrations.

The antifoulant may be added to the feed stream in any suitable manner. Preferably, the addition of the antifoulant is made under conditions whereby the antifoulant becomes highly dispersed. Preferably, the antifoulant is injected in solution (which may be colloidal) through an orifice under pressure to atomize the solution. The solvents previously discussed may be utilized to form the solutions. The concentration of the antifoulant in the solution should be such as to provide the desired concentration of antifoulant in the feed stream.

The cracking furnace may be operated at any suitable temperature and pressure. In the process of steam cracking of light hydrocarbons to ethylene, the temperature of the fluid flowing through the cracking tubes increases during its transit through the tubes and will attain a maximum temperature at the exit of the cracking furnace of about 850° C. The wall temperature of the cracking tubes will be higher, and may be substantially higher as an insulating layer of coke accumulates within the tubes. Furnace temperatures of nearly 2000° C. may be employed. Typical pressures for a cracking operation will generally be in the range of about 5 to about 20 psig at the outlet of the cracking tube.

Before referring specifically to the examples which further illustrate the present invention, the utilized laboratory testing apparatus will be described by referring to FIG. 1 in which a 9 millimeter quartz reactor 11 is illustrated. A part of the quartz reactor 11 is located inside the electric furnace 12. A metal coupon 13 is supported inside the reactor 11 on a two millimeter quartz rod 14 so as to provide only a minimal restriction to the flow of gases through the reactor 11. A hydrocarbon feed stream (ethylene) is provided to the reactor 11 through the combination of conduit means 16 and 17. Air (when employed during de-coking cycles) is provided to the reactor 11 through the combination of conduit means 18 and 17.

Nitrogen flowing through conduit means 21 is passed through a heated saturator 22 and is provided through conduit means 24 to the reactor 11. Water is provided to the saturator 22 from the tank 26 through conduit means 27. Conduit means 28 is utilized for pressure equalization.

Steam is generated by saturating the nitrogen carrier gas flowing through the saturator 22. The steam/nitrogen ratio is varied by adjusting the temperature of the electrically heated saturator 22. The reaction effluent is withdrawn from the reactor 11 through conduit means 31. Provision is made for diverting the reaction effluent to a gas chromatograph as desired for analysis.

In determining the rate of coke deposition on the metal coupon, the quantity of carbon monoxide produced during the cracking process was considered to be proportional to the quantity of coke deposited on the metal coupon. The rationale for this method of evaluating the effectiveness of the antifoulants was the assumption that carbon monoxide was produced from deposited coke by the carbon-steam reaction. Metal coupons examined at the conclusion of cracking runs bore essentially no free carbon which supports the assumption that the coke had been gasified with steam.

The selectivity of the converted ethylene to carbon monoxide was calculated according to equation 1 in which nitrogen was used as an internal standard.

$$\%\ \text{Selectivity (CO)} = \frac{(\text{mole \% CO/mole \% N}_2) \times 100}{\text{Conversion}} \quad (1)$$

The conversion was calculated according to equation 2.

$$\text{Conversion} = \frac{(\text{mole \% C}_2\text{H}_4/\text{mole \% N}_2)_{Feed} - (\text{mole \% C}_2\text{H}_4/\text{mole \% N}_2)_{Sample}}{(\text{mole \% C}_2\text{H}_4/\text{mole \% N}_2)_{Feed}} \quad (2)$$

The CO level for an entire cycle was calculated as a weighted average of all the analyses taken during a cycle according to equation 3.

$$\text{Time Weighted Selectivity} = \frac{\Sigma\text{Selectivity} \times \text{Time}^{\frac{1}{2}}}{\Sigma\text{Time}^{\frac{1}{2}}} \quad (3)$$

The percent selectivity is directly related to the quantity of carbon monoxide in the effluent flowing from the reactor.

The following examples are presented to further illustrate the present invention, and are not to be considered as unduly limiting the scope of this invention.

EXAMPLE I

Incoloy 800 coupons, 1"×¼"×1/16", were employed in this example. Prior to the application of a coating, each Incoloy 800 coupon was thoroughly cleaned with acetone. Each antifoulant was then applied by immersing the coupon in a minimum of 4 mL of the antifoulant/solvent solution for 1 minute. A new coupon was used for each antifoulant. The coating was then followed by heat treatment in air at 700° C. for 1 minute to decompose the antifoulant to its oxide and to remove any residual solvent. A blank coupon, used for comparison, was prepared by washing the coupon in acetone and heat treating it in air at 700° C. for 1 minute without any coating. The preparation of the various coating solutions are given below. (Note: M means mol/liter.)

0.5M Sn: 2.02 g of tin 2-ethylhexanoate, $Sn(C_8H_{15}O_2)_2$, was dissolved in enough n-hexane to make 10.0 mL of a solution, referred to hereinafter as Solution A.

0.5M Sb: 2.76 g of antimony 2-ethylhexanoate, $Sb(C_8H_{15}O_2)_3$, was mixed with enough n-hexane to make 10.0 mL of a solution, referred to hereinafter as Solution B.

0.5M Ti: 1.70 g of titanium n-butoxide, $Ti(OC_4H_9)_4$, was dissolved in enough toluene to make 10.0 mL of a solution, referred to hereinafter as Solution C.

0.5M Sn-Ti: 1.01 g tin 2-ethylhexanoate and 0.85 g titanium n-butoxide were dissolved in enough toluene to make 10.0 mL of an equimolar Sn-Ti solution, referred to hereinafter as Solution D.

0.5M Sb-Ti: 1.37 g antimony 2-ethylhexanoate and 0.86 g titanium n-butoxide were dissolved in enough toluene to make 10.0 mL of an equimolar Sb-Ti solution, referred to hereinafter as Solution E.

The temperature of the quartz reactor was maintained so that the hottest zone was 900°±5° C. A coupon was placed in the reactor while the reactor was at reaction temperature.

A typical run consisted of a 20 hour coking cycle (ethylene, nitrogen and steam), which was followed by a 5 minute nitrogen purge and a 50 minute decoking cycle (nitrogen, steam and air). During the coking cycle, a gas mixture consisting of 73 mL per minute ethylene, 145 mL per minute nitrogen and 73 mL per minute steam passed downflow through the reactor. Periodically, snap samples of the reactor effluent were analyzed in a gas chromatograph. The steam/hydrocarbon molar ratio was 1:1.

Table II summarizes results of runs with Incoloy 800 coupons that had been immersed in the test solutions A–E (previously described above).

TABLE II

| Run | Solution | Selectivity (% CO)[1] |
|---|---|---|
| 1 | None (Control) | 19.9 |
| 2 | A | 5.6 |

TABLE II-continued

| Run | Solution | Selectivity (% CO)[1] |
|---|---|---|
| 3 | B | 15.6 |
| 4 | C | 6.7 |
| 5 | D | 2.2 |
| 6 | E | 0.9 |

[1]Time weighted average percent CO selectivity

Results in Table II clearly show that the binary Sn-Ti combination (Solution D) and that the binary Sb-Ti combination (Solution E) were considerably more effective than Solutions A, B and C, respectively, containing tin alone, antimony alone and titanium alone, respectively.

EXAMPLE II

Using the process conditions of Example I, a plurality of runs were made using antifoulants which contained different ratios of tin and titanium and different ratios of antimony and titanium. Each run employed a new Incoloy 800 coupon which had been cleaned and treated as described in Example I. The antifoulant solutions were prepared as described in Example I with the exception that the atomic ratios of the elements were varied. The results of these tests are illustrated in FIGS. 2 and 3.

Referring to FIG. 2, it can be seen that the combination of tin and titanium was particularly effective when the concentration of tin was in the range of from about 10 mole percent to about 90 mole percent.

Referring now to FIG. 3, it can again be seen that the combination of antimony and titanium was most effective when the concentration of antimony was in the range of about 10 mole percent to about 90 mole percent.

Reasonable variations and modifications are possible by those skilled in the art within the scope of the described invention and the appended claims.

That which is claimed is:

1. A method for reducing the formation of coke on metals which are contacted with a gaseous stream containing hydrocarbons in a thermal cracking process comprising the step of contacting said metals with an antifoulant selected from the group consisting of a combination of titanium and tin and a combination of titanium and antimony.

2. A method in accordance with claim 1 wherein said step of contacting said metals with said antifoulant comprises contacting said metals with a solution of said antifoulant when said gaseous stream is not in contact with said metals.

3. A method in accordance with claim 2 wherein said metals are contacted with said solution for at least about 1 minute and wherein the concentration of said antifoulant in said solution is at least about 0.05 molar.

4. A method in accordance with claim 3 wherein the concentration of said antifoulant in said solution is in the range of about 0.3 molar to about 0.6 molar.

5. A method in accordance with claim 2 wherein the solvent used to form the solution of said antifoulant is selected from the group consisting of water, oxygen-containing organic liquids and liquid aliphatic, cycloaliphatic and aromatic hydrocarbons.

6. A method in accordance with claim 2 wherein said step of contacting said metals with said antifoulant additionally comprises the step of adding a suitable amount of said antifoulant to said gaseous stream before said metals are contacted with said gaseous stream.

7. A method in accordance with claim 6 wherein the concentration by weight of said antifoulant in said gaseous stream is at least 5 parts per million by weight of antifoulant metals based on the weight of the hydrocarbons in said gaseous stream.

8. A method in accordance with claim 6 wherein the concentration by weight of said antifoulant in said gaseous stream is about 10–100 parts per million by weight of antifoulant metals based on the weight of the hydrocarbons in said gaseous stream.

9. A method in accordance with claim 6 wherein said antifoulant is added to said gaseous stream by injecting a solution of said antifoulant through an orifice under pressure so as to atomize said solution.

10. A method in accordance with claim 1 wherein said step of contacting said metals with said antifoulant comprises the step of adding a suitable amount of said antifoulant to said gaseous stream before said metals are contacted with said gaseous stream.

11. A method in accordance with claim 10 wherein the concentration by weight of said antifoulant in said gaseous stream is at least 5 parts per million by weight of antifoulant metal based on the weight of the hydrocarbons in said gaseous stream.

12. A method in accordance with claim 10 wherein the concentration by weight of said antifoulant in said gaseous stream is about 10–100 parts per million by weight of antifoulant metal based on the weight of the hydrocarbons in said gaseous stream.

13. A method in accordance with claim 10 wherein said antifoulant is added to said gaseous stream by injecting a solution of said antifoulant through an orifice under pressure so as to atomize said solution.

14. A method in accordance with claim 1 wherein said antifoulant is a combination of titanium and tin.

15. A method in accordance with claim 1 wherein said antifoulant is a combination of titanium and antimony.

16. A process in accordance with claim 14, wherein the concentration of tin in said antifoulant is in the range of from about 10 mole percent to about 90 mole percent.

17. A process in accordance with claim 16, wherein said antifoulant comprises organic compounds of titanium and of tin.

18. A process in accordance with claim 17, wherein said antifoulant comprises at least one hydrocarboxide of titanium and at least one tin carboxylate.

19. A process in accordance with claim 18, wherein said antifoulant comprises titanium n-butoxide and stannous 2-ethylhexanoate.

20. A process in accordance with claim 15, wherein the concentration of antimony in said antifoulant is in the range of from about 10 mole percent to about 90 mole percent.

21. A process in accordance with claim 20, wherein said antifoulant comprises organic compounds of titanium and of antimony.

22. A process in accordance with claim 21, wherein said antifoulant comprises at least one hydrocarboxide of titanium and at least one antimony carboxylate.

23. A process in accordance with claim 22, wherein said antifoulant comprises titanium n-butoxide and antimony 2-ethylhexanoate.

* * * * *